US011162312B2

(12) United States Patent
McInally

(10) Patent No.: US 11,162,312 B2
(45) Date of Patent: Nov. 2, 2021

(54) DOWNHOLE TRACTOR COMPRISING TWO OR MORE HYDRUALIC SUPPLY LINES

(71) Applicant: Altus Intervention (Technologies) AS, Stavanger (NO)

(72) Inventor: Gerald McInally, Bryne (NO)

(73) Assignee: Altus Intervention (Technologies) AS, Stavanger (NO)

( * ) Notice: Subject to any disclaimer, the term of this patent is extended or adjusted under 35 U.S.C. 154(b) by 291 days.

(21) Appl. No.: 16/334,448

(22) PCT Filed: Oct. 4, 2017

(86) PCT No.: PCT/NO2017/050261
§ 371 (c)(1),
(2) Date: Mar. 19, 2019

(87) PCT Pub. No.: WO2018/067018
PCT Pub. Date: Apr. 12, 2018

(65) Prior Publication Data

US 2019/0219072 A1 Jul. 18, 2019

(30) Foreign Application Priority Data

Oct. 6, 2016 (NO) ..... 20161606

(51) Int. Cl.
*E21B 23/00* (2006.01)
*E21B 23/14* (2006.01)
(Continued)

(52) U.S. Cl.
CPC ..... *E21B 23/001* (2020.05); *E21B 23/00* (2013.01); *E21B 23/14* (2013.01); *F15B 11/20* (2013.01);
(Continued)

(58) Field of Classification Search
CPC .. F15B 11/20; F15B 13/07; F15B 2211/7052; F15B 2211/50518; F15B 2211/50536;
(Continued)

(56) References Cited

U.S. PATENT DOCUMENTS 4,210,061 A * 7/1980 Bianchetta ..... E02F 9/2239 60/484
2014/0014363 A1* 1/2014 Hallundbæk ..... E21B 23/14 166/374
2016/0116053 A1* 4/2016 Nystrom ..... F16H 57/0436 184/6.1

FOREIGN PATENT DOCUMENTS

EP 2505772 10/2012
WO WO 9015931 12/1990
(Continued)

*Primary Examiner* — George S Gray
(74) *Attorney, Agent, or Firm* — Gable Gotwals

(57) ABSTRACT

A downhole tractor has at least one hydraulic drive section, comprising a first hydraulic supply line for actuating at least one hydraulic cylinder for actuating at least one tractor arm and a second hydraulic supply line for driving at least one hydraulic motor for rotating at least one tractor wheel. The downhole tractor further comprises a hydraulic power pack configured for supplying hydraulic fluid to the hydraulic supply lines. The hydraulic power pack comprises a pressure-setting valve provided in between the first hydraulic supply line and the second hydraulic supply line, wherein the pressure-setting valve is configured for feeding excess hydraulic fluid in the first hydraulic supply line to the second hydraulic supply line to increase the speed of the downhole tractor.

9 Claims, 4 Drawing Sheets

(51) Int. Cl.
*F15B 11/20* (2006.01)
*F15B 13/07* (2006.01)

(52) U.S. Cl.
CPC ..... *F15B 13/07* (2013.01); *F15B 2211/20576* (2013.01); *F15B 2211/50518* (2013.01); *F15B 2211/50536* (2013.01); *F15B 2211/5155* (2013.01); *F15B 2211/7051* (2013.01); *F15B 2211/7052* (2013.01); *F15B 2211/7058* (2013.01); *F15B 2211/7135* (2013.01); *F15B 2211/7142* (2013.01); *F15B 2211/75* (2013.01)

(58) Field of Classification Search
CPC .... F15B 2211/20576; F15B 2211/5155; F15B 2211/7142; F15B 2211/75; F15B 2211/7051; F15B 2211/7058; F15B 2211/7135; E21B 23/14; E21B 23/00; E21B 23/001; E21B 23/04; E21B 23/0411–0423; E21B 34/14
See application file for complete search history.

(56) References Cited

FOREIGN PATENT DOCUMENTS

| | | |
|---|---|---|
| WO | WO 0046481 | 8/2000 |
| WO | WO 2009089838 | 7/2009 |
| WO | WO 2017142415 | 8/2017 |

* cited by examiner

DOWNHOLE TRACTOR COMPRISING TWO OR MORE HYDRUALIC SUPPLY LINES

CROSS-REFERENCE TO RELATED APPLICATIONS

This United States application is the National Phase of PCT Application No. PCT/NO2017/050261 filed 4 Oct. 2017, which claims priority to Norwegian Patent Application No. 20161606 filed 6 Oct. 2016, each of which is incorporated herein by reference.

FIELD OF THE INVENTION

The invention relates to a downhole tractor having at least one hydraulic drive section, comprising at least two hydraulic supply lines, of which one supply line is configured for actuating at least one hydraulic cylinder for driving a tractor arm and one supply line is for actuating at least one hydraulic motor for driving a tractor wheel, wherein the downhole tractor further comprises a hydraulic power pack configured for supplying hydraulic fluid to the hydraulic supply lines.

BACKGROUND OF THE INVENTION

Downhole tractors are typically used in the oil industry to gain access and perform operations inside oil wells. Downhole tractors are used as a conveyance platform to transport other well logging or well intervention equipment into the otherwise inaccessible highly deviated or horizontal sections of oil wells. In addition, downhole tractors can be used as a conveyance platform for milling and rotational equipment—not only in highly deviated and horizontal sections of oil wells, but also in more vertical sections. Milling and rotational equipment needs to be held in position, both in the axis of the well bore but also in against counter rotation torque generated by the milling bit rotation. Also especially for milling, the amount of force applied in an axial direction to the milling bit needs to be carefully controlled to provide the most effective milling action. The downhole tractor can provide both of these anchoring and weight on bit functions, in addition to acting as a general conveyance platform as described earlier.

There are a number of challenges in the operation of current downhole tractor technology, which are critical for the success or performance of a tractor conveyed operation.

- The speed at which the tractor can convey its payload in and out of the oil well is a key performance factor, i.e. the faster the job can be completed safely, the less valuable rig time is used and the faster the oil well can be put back into operation, which means less cost overhead for the oil well operator.
- In an oil well construction there can be many different completion elements such as transitions in tubing size, side pocket mandrel, sliding sleeves, etc. These elements may obstruct the tractor from progressing past such obstacle. This may limit the scope of use of tractors in some oil wells.
- For challenging tractor conveyed milling operations, total operator control of all milling parameters, including the axial force applied to the bit and optimizing the available torque of the milling motor, are very important for the success of the operation, but current tractor technology has limitations in the amount of control available.

A typical downhole tractor with hydraulic drive consists of the following elements: normally connected together in the following order: a control section with controls switching on and off the tractor function (either electronically or by mechanical means), a downhole motor (electrically powered or fluid driven turbine), a hydraulic pump with one or more outlets, a manifold block which controls the hydraulic functions, such as maximum pump pressure and the sequential deployment of the pump outputs. These elements constitute a hydraulic 'power pack' whose output consists of one or more controlled hydraulic supply lines and a hydraulic fluid return line.

Normally the tractor drive sections are modules, which can be added in parallel to the hydraulic supply lines provided by the power pack, so that sections can be added or removed as required. Due to the modular nature of the construction, drive sections can be added to provide more pulling force as needed, but although this does give more driving force for the same pump output pressure, it also means that more motors are consuming the available pump flow so that the available flow per motor reduces and thereby the conveyance speed of the tractor reduces.

With this type of construction in the current art, the tractor is built up from a certain number of modules based on the predicted job maximum requirements, but there is very little or no control of the configuration once the tractor is deployed in the well.

As is obviated in the discussion above the current prior art there is a need for further improving downhole tractor technology.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to a downhole tractor having at least one hydraulic drive section, comprising a first hydraulic supply line for actuating at least one hydraulic cylinder for actuating at least one tractor arm and a second hydraulic supply line for driving at least one hydraulic motor for rotating at least one tractor wheel. The downhole tractor further comprises a hydraulic power pack configured for supplying hydraulic fluid to the hydraulic supply lines. The hydraulic power pack comprises a pressure-setting valve provided in between the first hydraulic supply line and the second hydraulic supply line. The pressure-setting valve is configured for feeding excess hydraulic fluid in the first hydraulic supply line to the second hydraulic supply line to increase the speed of the downhole tractor.

The effects of the downhole tractor in accordance with the invention may be understood as follows.

A key feature of the downhole tractor in accordance with the invention is that there is a pressure setting valve provided in between the first hydraulic supply line and the second hydraulic supply line. Such a feature has never been reported before. Moreover, it clearly provides a great benefit over the existing electrohydraulic mechanical tractors. The pressure-setting valve allows dumping excess hydraulic fluid in the first hydraulic supply line to the second hydraulic supply line, instead of to tank (which actually is a pure waste) as is the case in the prior art systems, which leads to extra volume (hydraulic fluid) being made available for the hydraulic motors that drive the tractor wheels. The consequence of this feature is that the tractor becomes faster, while there is no negative side effect. The load on the pumps does not change when the pressure setting valve reaches its operating pressure and starts to feed hydraulic liquid to the second hydraulic supply line. This is in contrast with the prior art solutions where a change in the hydraulic system (for instance a reduction in the number of hydraulic drive sections in order to increase tractor speed) inevitably leads to an undesired effect, in this case a reduction in maximum available tractor pull force due to less available wheel drive motors. Wherever the word "tank" is used this is basically referring to the hydraulic return line system that is distributed over the downhole tractor.

In an embodiment of the downhole tractor in accordance with the invention the pressure-setting valve is a 3-port valve. It is convenient to use a three-port valve for the pressure-setting valve as this type of valve facilitates dumping to the second hydraulic supply line when the operating pressure with respect to tank has been reached.

In an embodiment of the downhole tractor in accordance with the invention the pressure-setting valve comprises a 3-port sequence valve, wherein an input port of the pressure-setting valve is connected to the first hydraulic supply line, wherein a sequence port of the pressure-setting valve is connected to the second hydraulic supply line, and wherein a drain port of the pressure-setting valve is connected to tank. Choosing a sequence valve ensures that the pressure at the input port may be regulated with regards to the pressure at the drain port independent of the back pressure at the sequence port. The pressure at the drain port is only used as a reference pressure.

In a first variant the sequence valve is a pilot operated, balanced piston sequence valve and in a second variant the sequence valve is a direct-acting sequence valve. Both sequence valve types have been proven to work.

In an embodiment of the downhole tractor in accordance with the invention the hydraulic power pack comprises a hydraulic switch placed in the second hydraulic supply line for selectively dumping hydraulic fluid in said second hydraulic supply line to tank to provide a low-speed driving mode of the downhole tractor where only flow from the first hydraulic supply line is used. The hydraulic switch may comprise a solenoid valve that is configured for (selectively) dumping to tank and a check-valve that is configured for preventing the hydraulic fluid in the second hydraulic supply line to flow back to the solenoid valve. Such low-speed driving mode is very advantageous in drilling operations. As mentioned earlier the hydraulic power pack is considered to comprise the pumps, motors, controller, as well as respective first parts of the hydraulic supply lines connected to the pumps, including their hydraulic components (valves, return lines, etc.). The hydraulic switch may be placed in the pump adapter of the hydraulic power pack, for example.

In an alternative embodiment the hydraulic power pack does not comprise a hydraulic switch, but is configured (this may be carried out manually in between different runs for example), such that hydraulic fluid for the second hydraulic supply line is dumped directly to tank. In this embodiment the use of a hydraulic switch (in the pump adapter) is dispensed with.

In a variant of last mentioned-alternative embodiment the hydraulic power pack comprises a pump, a pump adapter connected to the pump, and a manifold block comprising the first hydraulic supply line and the second hydraulic supply line. The first hydraulic supply line is directly fed by the pump adapter. The second hydraulic supply line is only fed by the pump via the pressure-setting valve. This embodiment is advantageous in that it only requires one pump to feed two hydraulic supply lines. Such special configuration is made possible to by the pressure-setting valve in accordance with the invention.

In an embodiment of the downhole tractor in accordance with the invention the first hydraulic supply line is bidirectional.

In an embodiment of the downhole tractor in accordance with the invention the second hydraulic supply line is unidirectional.

BRIEF INTRODUCTION OF THE DRAWINGS

In the following is described examples of preferred embodiments illustrated in the accompanying drawings, wherein.

DETAILED DESCRIPTION OF THE EMBODIMENTS

Figure 1:
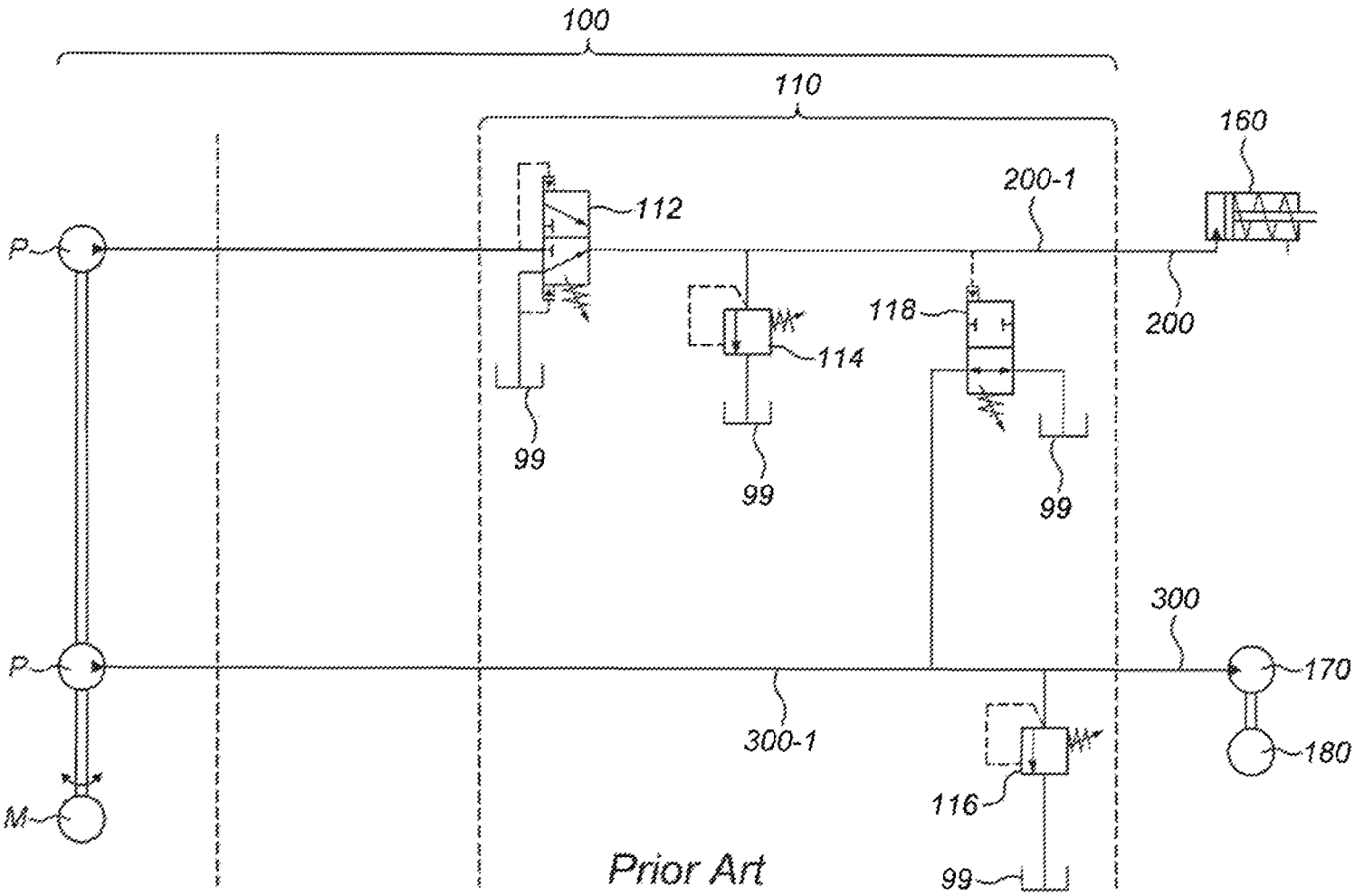
Prior Art Fig. 1
FIG. 1 shows a hydraulic system of a downhole tractor in accordance with the prior art.

In the figure description following hereinafter a lot of implementation details have been omitted, such details being known to the person skilled in the art of downhole tractors and hydraulic systems for downhole tractors. More implementation details can also be found in EP2,505,772 A1 for example.

The current invention can be used to improve some of the above operational challenges as described in the introduction. The invention applies to downhole tractors, which employ two or more hydraulic circuits with functions like actuating the drive mechanism (tractor arm) via a first hydraulic (bi-directional) supply line, so that it engages with the well bore, and driving the drive mechanism (tractor wheel) via a second hydraulic (unidirectional) supply line. There may be further hydraulic supply lines present in the downhole tractor.

A wireline tractor is used in wireline operations in petroleum wells. These operations can be anchoring for mechanical operations like brushing, drilling, collection of deposits or debris, or transportation of other equipment into the horizontal parts of the well. Transport of equipment forms the major part of the wireline tractor operations. This operation is carried out all the time and everywhere. In order to make these transportation operations efficient tough comprehensive requirements are set for the downhole tractor. Reliability is also one of these requirements in order to carry out operations as quickly and efficient as possible. The reason why reliability is so important is that in case of incompletely operations or technical failure in the tool string, the equipment needs to be pulled out and inspected for errors and other failure. In case of such error or failure this needs to be fixed and a new trip into the well must be carried out. This steals production time and results in a poor efficiency and unnecessary use of personnel and equipment.

The reliability of today's downhole equipment has improved dramatically and no longer represents the biggest challenge in carrying out the operations. Faster downhole tractors will give a strong competitive advantage and further improve the efficiency, and lower tool and personnel usage. In case of errors or failures in the equipment with the required extra run into the well, a faster delivery by the downhole tractor would be a big advantage and minimize unproductivity.

Today two different systems for propulsion of wireline tractors are used, namely electro-mechanical and electrohydraulic mechanical systems. It is difficult to distinguish these systems for an outsider, but each of these systems has its own advantages and disadvantages.

The current invention aims to improve the hydraulic system in electrohydraulic mechanical downhole tractors. A downhole tractor with hydraulics uses the hydraulic system for performing to tasks, namely activation of a piston that presses a pivotable arm (with a wheel) against the sidewall of the well, and the propulsion of a hydraulic motor for driving a wheel.

Hydraulic tractor systems are principally built up as follows:

1. An electronics unit—This unit communicates with the surface panels and controls activation and propulsion of the tractor system, including steering and control of the signals on the electric cables that are distributed throughout the tractor.
2. A motor unit—This unit includes the electromotor, the hydraulic pump and the manifold for generating and distributing the hydraulic propulsion pressure.
3. Driving sections—This unit includes two or more arm systems per driving section.
4. A compensator—This unit regulates the internal pressure in relation to the ambient pressure of the system, and feeds hydraulic oil to compensate for leakage.

There exist hydraulic systems having only one hydraulic circuit (a hydraulic supply line with a return line). In these systems the single hydraulic circuit activates both the pivotable arms as well as the wheels. The invention is not suitable for improving such systems.

The invention aims at improving hydraulic systems having at least two hydraulic circuits, i.e. two or more supply lines, wherein one hydraulic supply line activates the pivotable arms and the other hydraulic supply line activates the wheels.

The hydraulic system uses hydraulic power generated by an electric motor and a pump. The pump generates volume and pressure to two different separated hydraulic circuits, whereas the manifold that is coupled to the pump regulates the pressure as well as the on- and off-function.

At the start-up of the hydraulic system the hydraulic pressure is generated by the motor/pump system and provided to the arm and wheel propulsion. The arm pressure is held constant at a predefined level and any excess volume is fed to the tank. The biggest (hydraulic) volume is fed to the wheel motors for propulsion of the system. The whole hydraulic circuit is optimized for minimal friction and for maximal use of the available hydraulic power. The wheel motors, the gearing ratio from the motors to the wheels and the wheel size are all calculated and dimensioned to provide the desired propulsion force.

Less friction as well as a larger generated hydraulic volume in the hydraulic circuit will increase the speed of the wheel propulsion system.

FIG. 1 shows a hydraulic system of a downhole tractor in accordance with the prior art. The hydraulic system shows a hydraulic power pack 100 that is configured for driving two hydraulic supply lines 200, 300 (each forming a respective hydraulic circuit together with a supply line to (hydraulic) tank 99). The hydraulic power pack 100 comprises an electric motor M that drives two pumps P, and a manifold block 110 coupled to said pumps P as illustrated. The manifold block 110 comprises respective first parts 200-1, 300-1 of said hydraulic supply lines 200, 300. The first hydraulic supply line 200 is a bidirectional hydraulic supply line and is connected to a hydraulic cylinder 160 for driving a tractor arm (not shown). The second hydraulic supply line 300 is a unidirectional hydraulic supply line and is connected to a hydraulic motor 170 for driving a tractor wheel 180. In FIG. 1 only one hydraulic cylinder 160 and only one hydraulic motor 170 with one tractor wheel 180 have been drawn. However, in practise this may be any other number.

The manifold block 110 comprises a (3-port) sequence valve 112 and a relief valve 114 within the first hydraulic supply line 200 as illustrated. The relief valve 114 is configured for holding the right pressure on the first hydraulic supply line 200 as earlier discussed. Both the sequence valve 112 and the relief valve 114 are connected to tank 99 as illustrated. The manifold block 110 further comprises a further relief valve 116 and a further sequence valve 118 within the manifold block 110 as illustrated. Both the further relief valve 116 and the further sequence valve 118 are connected to tank 99 as illustrated.

Figure 2:
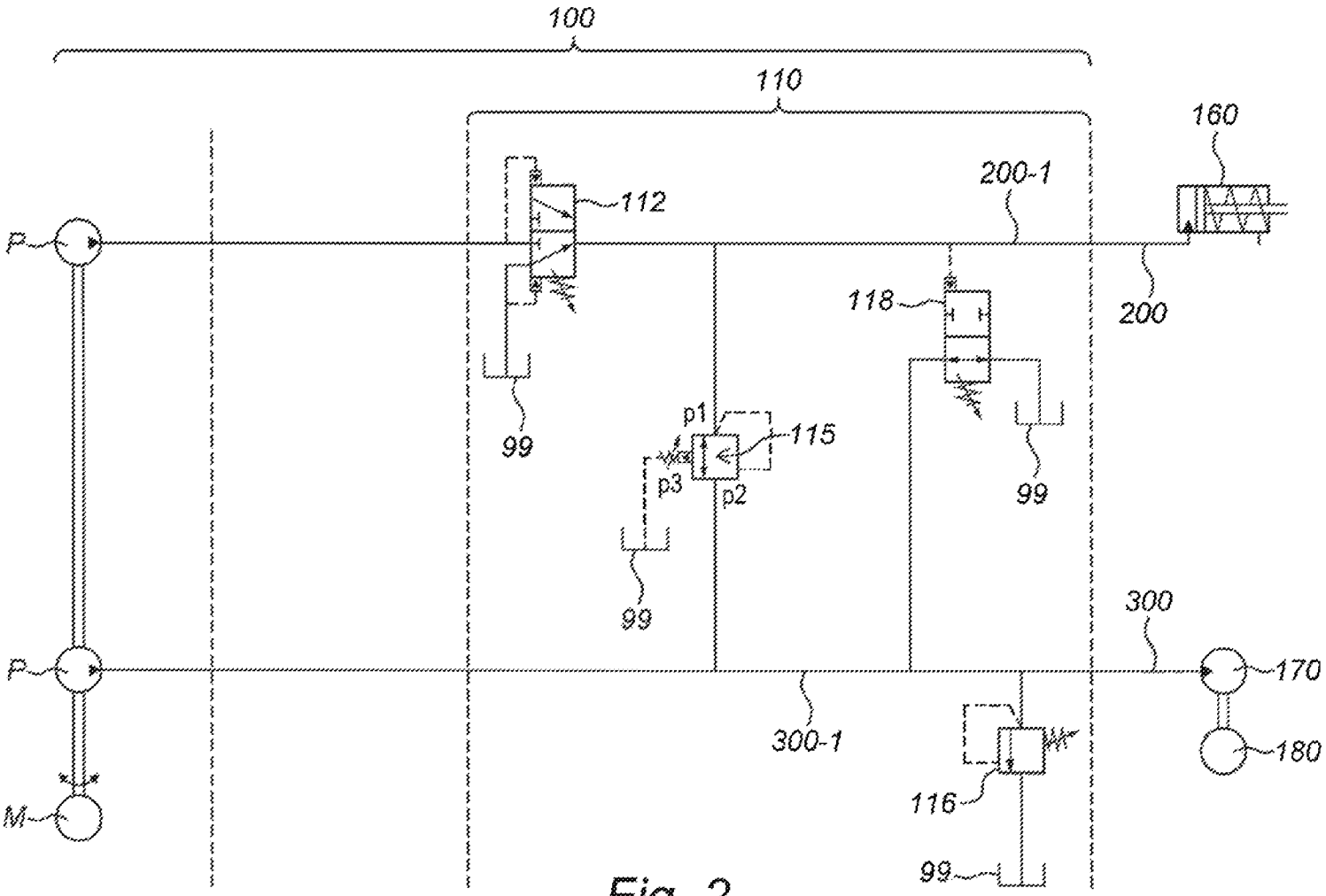
FIG. 2 shows a hydraulic system of a downhole tractor in accordance with a first embodiment of the invention.

FIG. 2 shows a hydraulic system of a downhole tractor in accordance with a first embodiment of the invention. This embodiment will be discussed in as far as it differs from FIG. 1. The main differences are that the relief valve 114 in the first hydraulic line 200-1 is removed and that a pressure-setting valve 115 is placed in between the first hydraulic supply line 200, 200-1 and the second hydraulic supply line 300, 300-1. The pressure-setting valve 115 in this embodiment is a 3-port sequence valve. The sequence valve 115 comprises an input port p1 connected to the first hydraulic supply line 200, 200-1, a drain port p3 connected to the tank 99 and a sequence port p2 connected to the second hydraulic supply line 300, 300-1.

The hydraulic system of FIG. 2 allows for the increase of the propulsion speed (driving speed) without changing the motor M or the pump P. The invention improves the system by leading all excess volume on the first hydraulic supply line 200, 200-1 to the second hydraulic supply line 300, 300-1. This is possible because the activation pressure of the hydraulic cylinders 160 (first hydraulic supply line 200, 200-1) is higher than the pressure in the second hydraulic supply line 300, 300-1, which provides the hydraulic motors 170 with energy. In FIG. 2 the pressure-setting valve 115 acts as a new kind of discharge (relief) or injection valve, which allows to keep the pressure in the hydraulic cylinders 160 (arms) constant, and discharges all excess volume (excess pressure) and injects this into the second hydraulic supply line 300, 300-1.

The 3-port sequence valve 115 in FIG. 2 is a pilot-operated, balanced piston sequence valve. In an alternative embodiment sequence valve 115 may be a direct-acting sequence valve. Sequence valves will supply a secondary circuit with flow once the pressure at the inlet (input port) has exceeded the valve setting. The pressure setting of a sequence valve controls the pressure at the input port relative to the pressure at the drain port. These valves are insensitive to back pressure at sequence port, up to the valve setting. In contrast with this, 2-port relief valves may fail to work if there is pressure at the output side.

Figure 3:
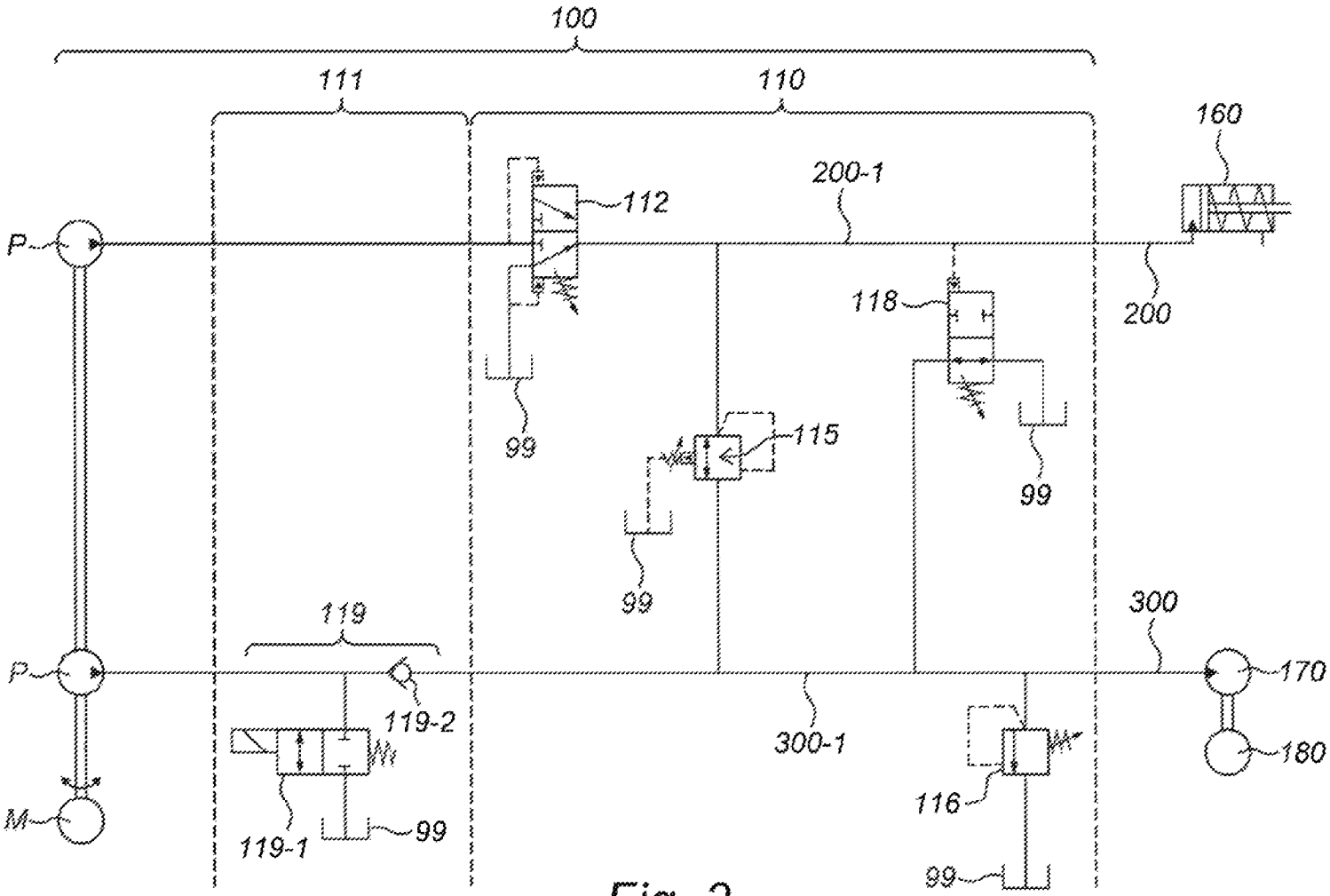
FIG. 3 shows a hydraulic system of a downhole tractor in accordance with a second embodiment of the invention.

FIG. 3 shows a hydraulic system of a downhole tractor in accordance with a second embodiment of the invention. This embodiment will be discussed in as far as it differs from FIG. 2. The main difference is that the circuit comprises a controllable switch 119 within a pump adapter 111 in between the manifold block 110 and the pumps P. This hydraulic switch 119 is provided in the second hydraulic supply line 300-1 and comprises a 3-port solenoid valve 119-1 and a check valve 119-2 as illustrated. The 3-port solenoid valve 119-1 is configured for allowing, in a first state, the generated hydraulic volume of the lower pump P to flow directly to tank 99. The 3-port solenoid valve 119-1 is further configured for allowing, in a second state, the generated hydraulic volume of the lower pump P to flow into the second hydraulic supply line 300-1. The check valve 119-2 is provided to prevent hydraulic fluid in the second hydraulic supply line 300, 300-1 to flow back into the 3-port solenoid valve 119-1. In an alternative embodiment the pump adapter does not comprise a hydraulic switch 119, but is (manually) (re)configured such that the second pump P dumps its hydraulic fluid directly to tank. In yet an alternative embodiment there may be only one pump P present feeding both hydraulic supply lines 200-1, 300-1 in the manifold block 110.

The embodiment of FIG. 3 conveniently provides for a so-called low-speed driving mode (or low-gear mode or crawl-gear mode). In case a low speed with high pulling power is desired with low-power usage, the embodiment of FIG. 3 is very advantageous. Low-speed or low-gear driving mode may be advantageous in a tool string, wherein an auxiliary motor is used. Such auxiliary motor, in addition to the wireline tractor itself, may be used for rotating equipment, dust collection, suction tools, etc. In case of activation of the auxiliary motor, such as a pump device for a suction tool, it is desired to provide this auxiliary motor with maximal power, while the power to the tractor is minimized. The embodiment of FIG. 3 allows for the dumping of the hydraulic fluid generated for the second hydraulic supply line 300 to tank 99 by placing the controllable switch 119 in the position as drawn. At the same time the hydraulic fluid generated in the other hydraulic circuit may be used for both the first hydraulic supply line 200, 200-1 and the second hydraulic supply line 300, 300-1, wherein excess hydraulic fluid in the first hydraulic supply line 200-1 is fed to the second hydraulic supply line 300-1, via the pressure-setting valve 115. In this state, the downhole tractor will provide proper anchoring against the walls of the well, while the providing a low-speed operation of the tractor wheels (because of a reduced hydraulic flow in the second hydraulic supply line 300, 300-1).

Figure 4:
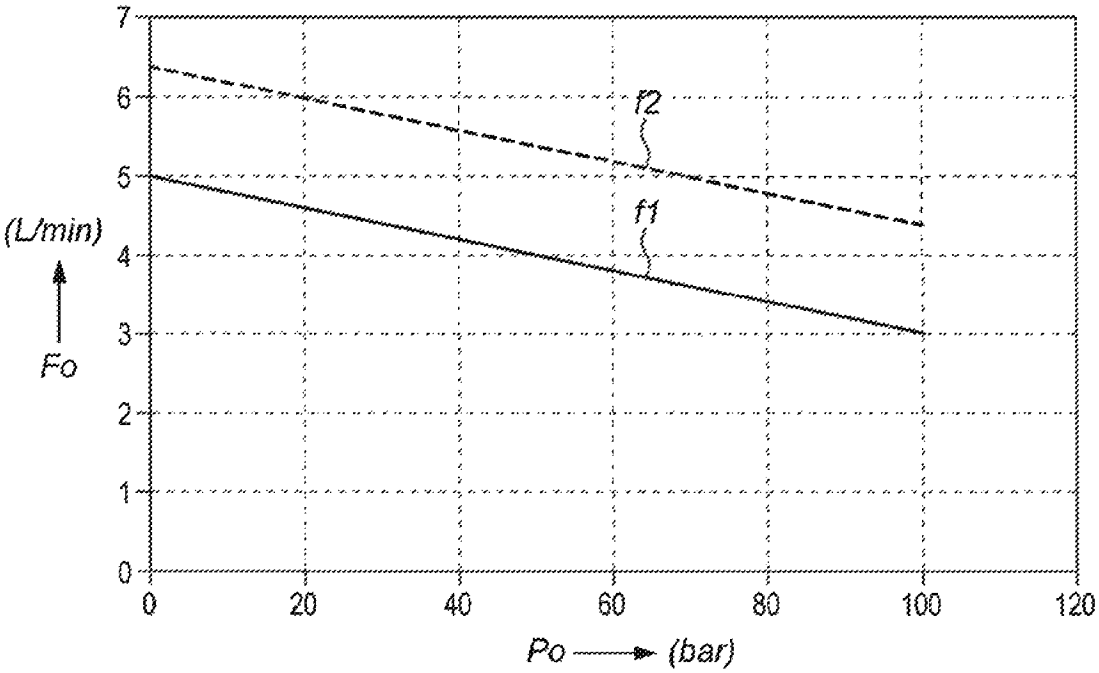
FIG. 4 shows a graph illustrating the positive effect of the invention.

FIG. 4 shows a graph illustrating the positive effect of the invention. This graph shows experimental results of the output rotation low Fo (in L/min) as a function of the output pressure Po (in bar), for prior art speed driving mode (lower curve f1) as well as the high-speed driving mode (upper curve f2). These experiments show that the invention provides up to 25% speed increase for the downhole tractor.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. A downhole tractor having at least one hydraulic drive section, the downhole tractor comprising:

a first hydraulic supply line (200, 200-1) for actuating at least one hydraulic cylinder (160) for actuating at least one tractor arm and a second hydraulic supply line (300, 300-1) for driving at least one hydraulic motor (170) for rotating at least one tractor wheel; and a hydraulic power pack (100) configured for supplying hydraulic fluid to the hydraulic supply lines (200, 200-1, 300, 300-1), wherein the hydraulic power pack (100) comprises a pressure-setting valve (115) provided between the first hydraulic supply line (200, 200-1) and the second hydraulic supply line (300, 300-1), the pressure-setting valve (115) being configured to hold a preset pressure on an input side of the pressure-setting valve (115) and supply the hydraulic fluid to the first hydraulic supply line (200, 200-1) and, at the same time, for feeding excess hydraulic fluid in the first hydraulic supply line (200, 200-1) to the second hydraulic supply line (300, 300-1) to increase the speed of the downhole tractor, the first hydraulic supply line (200, 200-1) being at a higher pressure than the second hydraulic supply line (300, 300-1).

2. The downhole tractor according to claim 1, wherein the pressure-setting valve (115) is a 3-port valve.

3. The downhole tractor according to claim 2, wherein the pressure-setting valve (115) comprises a 3-port sequence valve, wherein an input port (p1) of the pressure-setting valve (115) is connected to the first hydraulic supply line (200, 200-1), a sequence port (p2) of the pressure-setting valve (115) is connected to the second hydraulic supply line (300, 300-1), and a drain port (p3) of the pressure-setting valve (115) is connected to a tank (99).

4. The downhole tractor according to claim 3, wherein the pressure-setting valve (115) is selected from the group consisting of a pilot operated, balanced piston sequence valve and a direct-acting sequence valve.

5. The downhole tractor according to claim 1, wherein the hydraulic power pack (100) comprises a hydraulic switch (119) placed in the second hydraulic supply line (300, 300-1) for selectively dumping hydraulic fluid in said second hydraulic supply line (300, 300-1) to a tank (99), to provide a low-speed driving mode of the downhole tractor where only flow from the first supply line is used.

6. The downhole tractor according to claim 1, wherein the hydraulic power pack (100) is configured such that hydraulic fluid for the second hydraulic supply line (300-1) is dumped directly to a tank (99).

7. The downhole tractor according to claim 1, wherein the hydraulic power pack (100) comprises a pump (P), a pump adapter (111) connected to the pump (P), and a manifold block (110) comprising the first hydraulic supply line (200-1) and the second hydraulic supply line (300-1), wherein the first hydraulic supply line (200-1) is directly fed by the pump adapter (111), and wherein the second hydraulic supply line (300-1) is only fed by the pump (P) via the pressure-setting valve (115).

8. The downhole tractor according to claim 1, wherein the first hydraulic supply line (200, 200-1) is bidirectional.

9. The downhole tractor according to claim 1, wherein the second hydraulic supply line (300, 300-1) is unidirectional.

* * * * *